US006695679B2

(12) United States Patent
Anderson et al.

(10) Patent No.: US 6,695,679 B2
(45) Date of Patent: Feb. 24, 2004

(54) ENABLEMENT OF SELECTION OF GAS/DRY ICE RATIOS WITHIN AN ALLOWABLE RANGE, AND DYNAMIC MAINTENANCE OF THE RATIO IN A BLASTING STREAM

(75) Inventors: Robert S. Anderson, Whittier, CA (US); Scott M. Stafford, Alta Loma, CA (US)

(73) Assignee: CAE Alpheus, Inc., Rancho Cucamonga, CA (US)

( * ) Notice: Subject to any disclaimer, the term of this patent is extended or adjusted under 35 U.S.C. 154(b) by 291 days.

(21) Appl. No.: 09/978,508

(22) Filed: Oct. 15, 2001

(65) Prior Publication Data

US 2003/0073380 A1 Apr. 17, 2003

(51) Int. Cl.[7] ..... B24C 3/00

(52) U.S. Cl. ..... 451/2; 451/39; 451/90

(58) Field of Search ..... 451/2, 39, 75, 451/90, 99, 102

(56) References Cited

U.S. PATENT DOCUMENTS 5,779,523 A * 7/1998 Mesher ..... 451/93
5,785,581 A * 7/1998 Settles ..... 451/99

* cited by examiner

*Primary Examiner*—Joseph J. Hail, III
*Assistant Examiner*—David B. Thomas
(74) *Attorney, Agent, or Firm*—Frost Brown Todd LLC

(57) ABSTRACT

Apparatus and method to establish permissible ranges of the gas/dry ice ratio in a dry ice blasting stream. Logic and circuitry determine whether a proposed ratio is permissible. If it is, it enables the process to start. If it is not, it forbids operation of the process.

15 Claims, 5 Drawing Sheets

ENABLEMENT OF SELECTION OF GAS/DRY ICE RATIOS WITHIN AN ALLOWABLE RANGE, AND DYNAMIC MAINTENANCE OF THE RATIO IN A BLASTING STREAM

FIELD OF THE INVENTION

In dry ice blasting, enabling the selection and dynamically maintaining a gas/dry ice ratio which is selected and is within an allowable range of ratios, and forbidding the selection of a ratio outside of the allowable range.

BACKGROUND OF THE INVENTION

The art of dry ice blasting involves the impact on a surface to be cleaned by a blasting stream consisting of particles of dry ice in a gas carrier stream. Important parameters include the size (mass) of the particles and the ratio of the masses of gas and the dry ice ("gas/dry ice ratio" herein).

Recently-improved apparatus for supplying dry ice particles have presented the opportunity more precisely to match the size of particles and their rate of supply to various flow rates of the gas in varieties of blast cleaning applications. However, those advantages can be lost if the operator is unaware of what is actually occurring in the apparatus, or if he has selected some ratio which is inappropriate to the intended application.

For example, it is possible that an operator to reduce operating costs, would choose a ratio so heavily favoring the gas that there would be insufficient particles to do the job, and that too many of them might be reduced in mass by sublimation. Even more troubling would be his selection of a ratio too heavily favoring the dry ice particles such that the nozzle would plug up and the process stopped. Furthermore excessive dry ice mass could tend to harm delicate objects.

An obvious solution to this problem is simply to train the operator better. This is frequently unworkable because of employee reassignments, and the sporadic use of this equipment.

Another seemingly obvious solution is to limit the operating ranges narrowly and provide many configurations. This leads to confusion and increased equipment expense.

Charts and diagrams are similarly useless because the operator may not understand them, or may choose incorrectly. Perhaps he would not even use them.

Accordingly, it is an object of this invention to provide a system and method based on mass flow of the gas, which will automatically limit selection of gas/dry ice ratios to only an allowable range for a given application, and prevent selection or operation outside of the range. Operation of such a system requires no more basic input than the selection of a gas flow rate respective to a selected gas pressure. Experience and instruction will teach what pressure is desirable for a given task.

This in itself can establish a range of acceptable gas/dry ice ratios. Depending on the nature of the cleaning work to be done, the system may select the ratio, or the operator may select an exact ratio, but only in the permitted range.

This arrangement also makes available the association of specific nozzles in establishing allowable ranges and ratios.

Its is therefore an object of this invention to simplify and authenticate the choice and maintenance of gas/dry ice ratios in a blasting stream.

BRIEF DESCRIPTION OF THE INVENTION

Apparatus for dry ice blasting conventionally includes a particle source which supplies dry ice particles of selected size and mass at a regulated rate, a source of pressurized gas such as an air compressor when air is used as the carrier gas, a hose receiving the mixed gas and dry ice, and a nozzle for discharging the blasting stream toward a surface to be cleaned.

A major parameter in dry ice blasting is the pressure of the stream. The operator is expected to select an appropriate pressure. The gas flow rate at this pressure is sensed either directly or indirectly. Under control of an adjustable regulator, it will pass the gas from the supply at the selected flow rate.

In one embodiment of the invention, the flow rate is directly measured by a conventional flow meter. In another embodiment it is indirectly determined by measuring the pressure, and with knowledge of the properties of the nozzle orifice, deducing the flow rate. In both embodiments, the control is by a responsive regulator which will pass gas at a selected rate at a given pressure.

The ratio of the combined stream is established by the rate of supply of the dry ice. The dry ice supply is from a particle source which will be operated at a rate to produce the necessary amount of particles to make the correct ratio in the established flow of gas. Accordingly, the regulator control over the particle source is slaved to the gas flow regulator, so the correct ratio will be maintained.

According to this invention, the intended pressure is first selected. Then the airflow rate will be learned or known. Logic within the system establishes a range of gas/ice dry ice ranges that is acceptable. Then the control will establish a ratio, or the operator can select other ratios, but only within the operating range established by the control.

Thereafter, the master/slave relationship of the two regulators will dynamically maintain the supply of dry ice to provide a stream with the correct ratio.

The flow rate may also be deduced from pressure and identity of the nozzle. Nozzles can be physically configured or color coded to indicate their properties as related to measurement of flow at a given pressure.

The above and other features of this invention will be fully understood from the following detailed description and the accompanying drawings, in which:

DETAILED DESCRIPTION OF THE INVENTION

FIGS. 1–4 show various control schemes to maintain a proper gas/dry ice ratio for various ratios of airflow. They all begin with the assumption that pressure of the stream is a major criterion, and that the gas flow (often for convenience referred to simply as "airflow", as is "ice" used to denote dry ice and not water ice) rate at a given pressure may vary depending on the nozzle configuration. In all cases, however, the gas/ice ratio must be in a range of values where the stream will not plug the nozzle, or where it would provide too little ice to do the intended work. In fact, while the acceptable (permissible) operating range for the ratio may extend from about 1:1 to about 7:1, the best rate based on wide experience is between about 3:1 and about 3.5:1. In some embodiments of this invention the system will provide ice at a rate to establish a ratio in the preferred range, subject to override by the operator to a more individualized setting, but within the permissible range.

It is evident that to establish a correct ratio, there must be the correct amount of ice per unit of gas flow. However, the gas flow measurement in cubic feet per minute (cfm) is of little or no use to an operator who is skilled only in the use of the apparatus. He does, however, have instructions or knowledge about the pressure to be used. The same high pressure, for example, would not be used on delicate articles as would be needed to clean paint from an oil well tool. Also, he may wish to put more or less ice in the blasting stream, in effect "fine-tuning" an automatic setting more exactly to meet the needs of a specific job.

Accordingly this control begins with selection of pressure. Depending on downstream configuration namely of the nozzle, the airflow rate will be deducible, or without specific input of nozzle conditions, directly measured.

With this knowledge an airflow rate and the rate of supply of ice can be regulated to constitute a stream with the desired air/ice ratio. This is done by slaving the ice regulator to the gas regulator.

Figure 1:
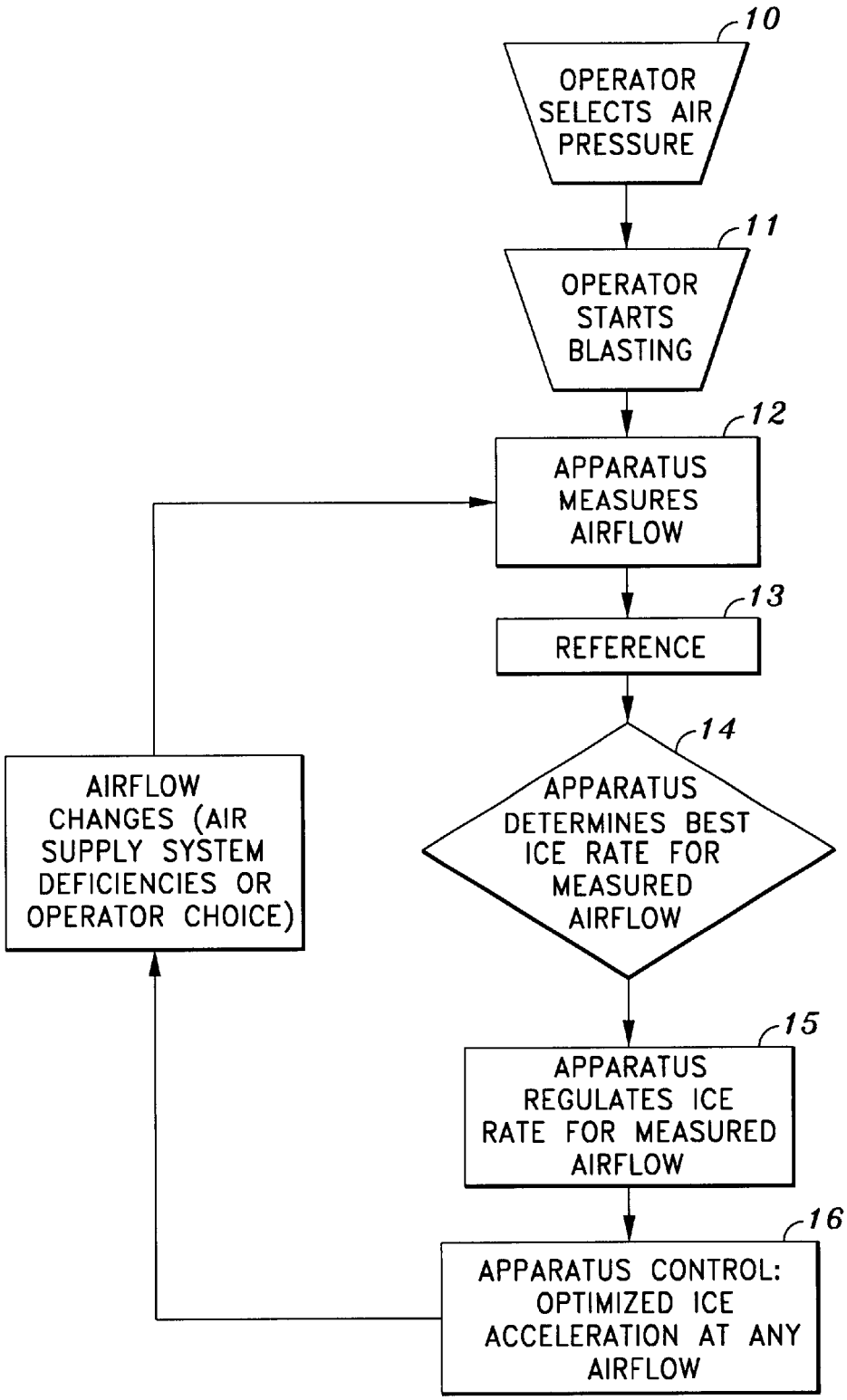
FIGS. 1–4 are logic diagrams of control systems useful in this invention.

FIG. 1 constitutes a logic flow chart in the simplest system. It begins with selection of air pressure by the operator (block 10), who then starts the blasting operation, usually by pressing a trigger that controls a valve at the nozzle (block 11). At this moment the apparatus measures the airflow rate (block 12).

At this point it is repeated that the airflow rate may be directly measured by a flow meter or may indirectly be deduced from knowledged of the pressure and nozzle configuration. In block 12 direct measurement is presumed, but not exclusive.

A reference (block 13) in the nature of a look-up table is consulted for best ratio (best ice supply rate) for the measured airflow, and the best rate is determined (block 14).

Responsive apparatus will regulate the selected ice rate for the measured airflow rate (block 15). Thus, the ice regulator is slaved to the airflow regulator.

Figure 2:
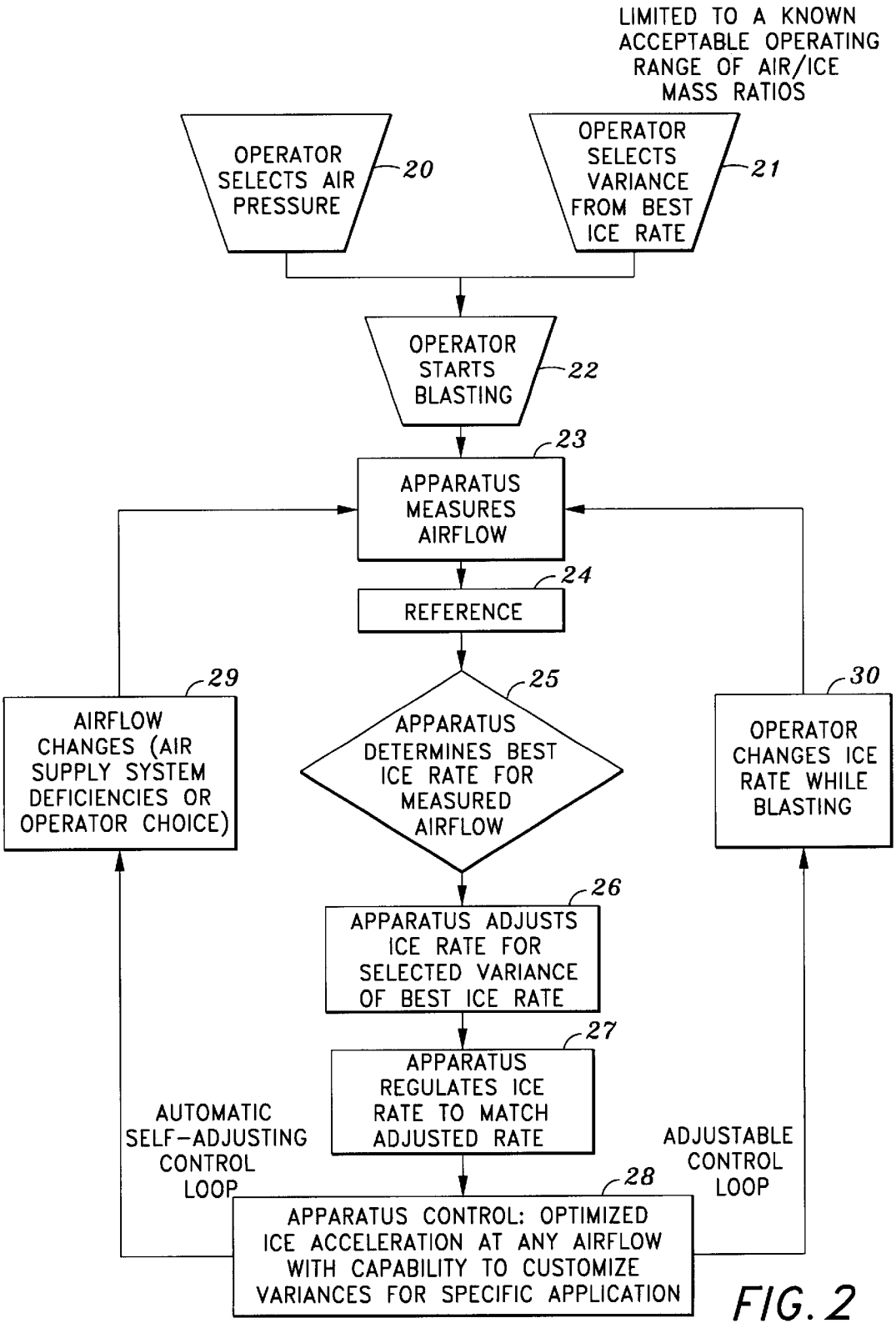

The control scheme of FIG. 2 is generally similar to that of FIG. 1, except that at the outside the operator can select a variance in the ratio from the best rate that otherwise would have been selected.

Again, the operator selects the intended pressure (block 20), but he also enters a variance in the ratio—more or less ice per unit of gas mass (block 21). This variance will be limited so it does not result in an improper ratio, and blasting is started (block 22).

Thereafter, as in FIG. 1, airflow is measured (block 23), reference is made to block 24, and best ice rate is determined (block 25). In this embodiment, adjustment of the best rate is made (block 26) to conform with the variance and to be certain it is a valid ratio.

Blocks 27 and 28 provide for the continuing operation and control.

Blocks 29 and 30 attend to maintaining control when output conditions change, or are charged by the operator.

Figure 3:
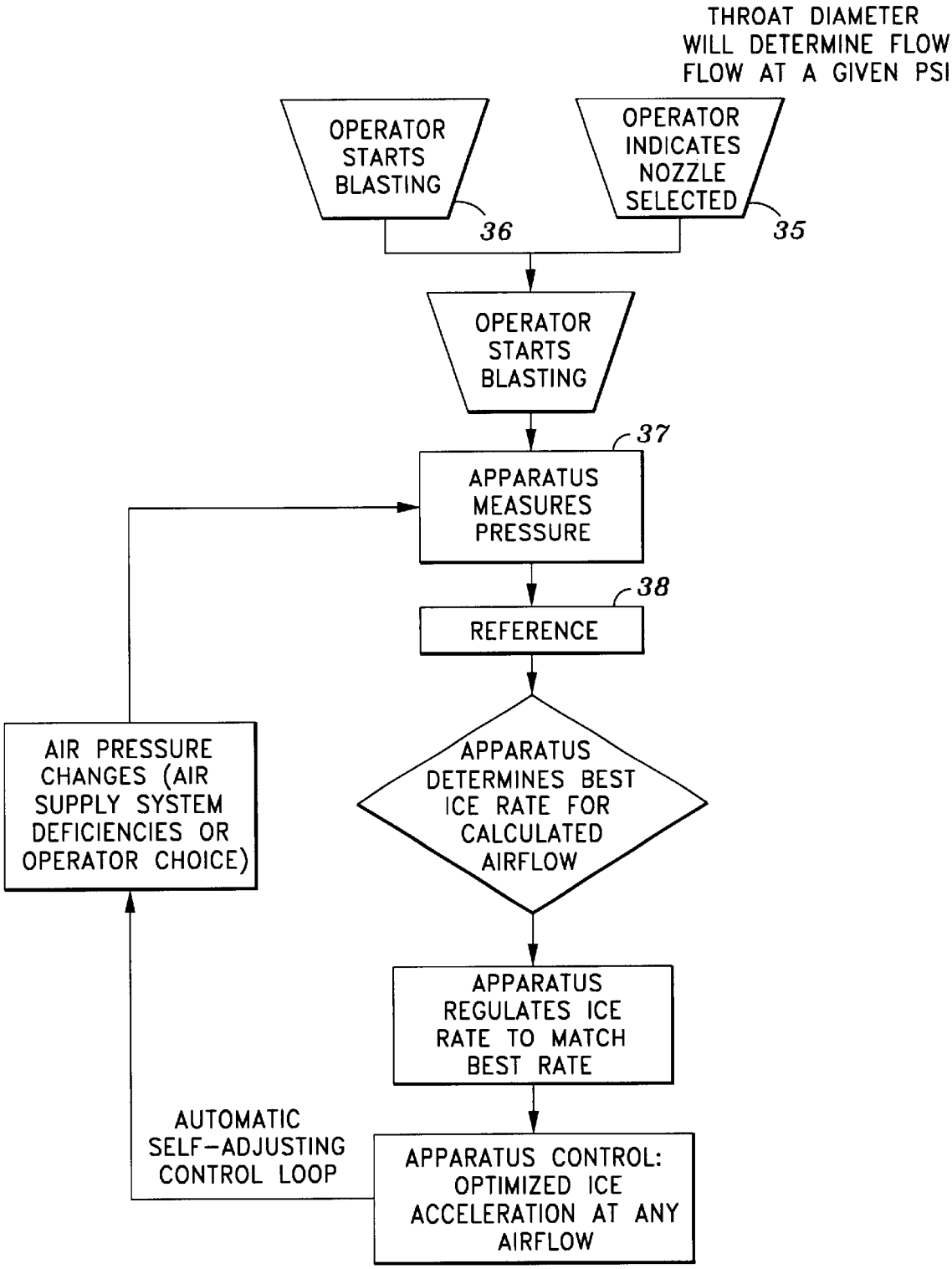

FIG. 3 shows control logic which is similar to that of FIG. 1. In FIG. 1, the airflow is directly measured. In FIG. 3 it is deduced from the known pressure and the known properties of the selected nozzle. Block 35 shows the selection of a nozzle, whose properties will be known in the reference. Again, the operator selects the pressure (block 36).

Knowledge of the flow rate is obtained from the measurement of pressure (block 37), and knowledge in the reference (block 38) of the nozzle properties. The remainder of the logic system is evident from the discussion of FIG. 1.

Figure 4:
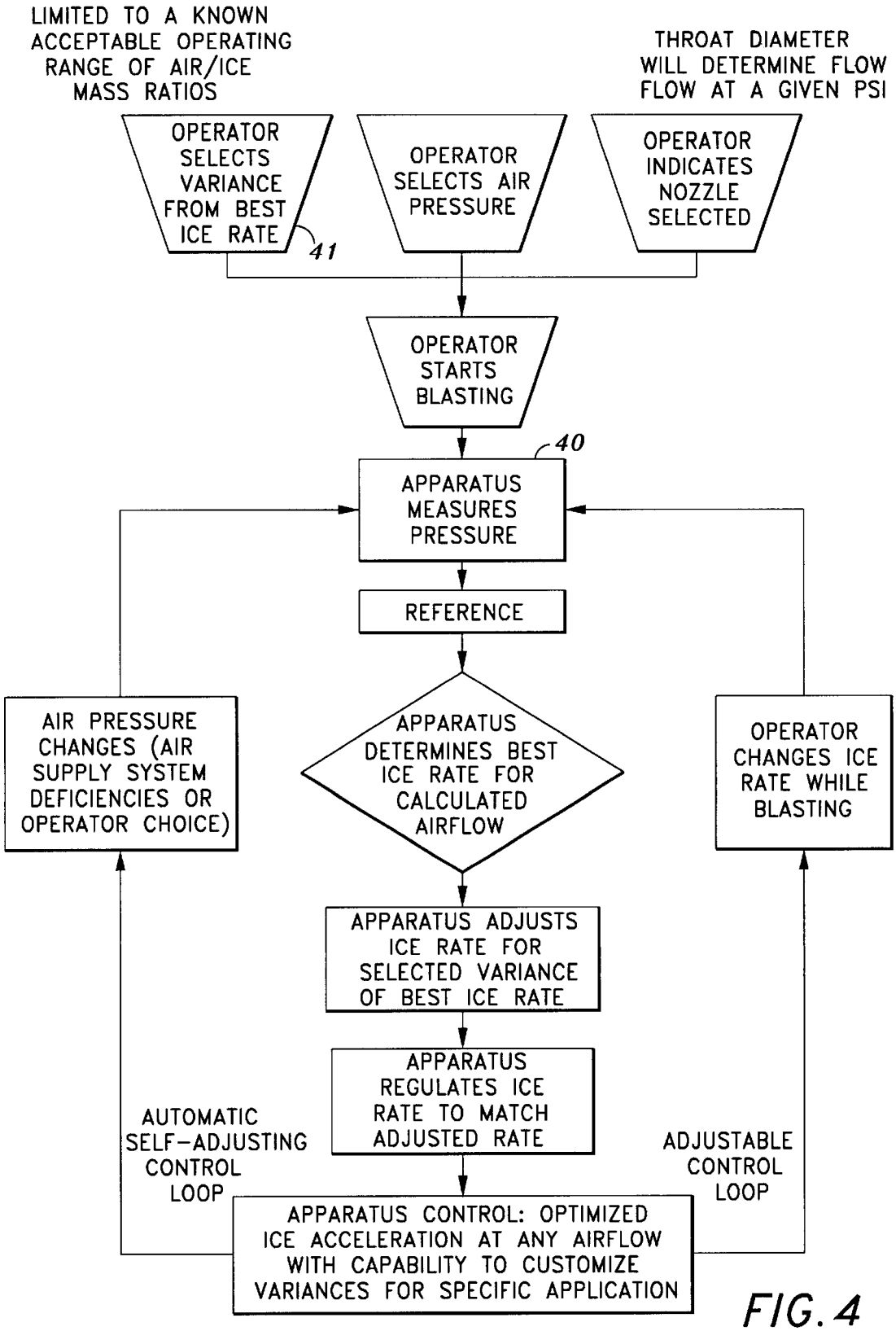

The logic of FIG. 4 closely resembles that of FIG. 2, to which reference is made. It differs (as FIG. 3 differs from FIG. 1) in the use of measured pressure to deduce the airflow rate (block 40). It further includes the opportunity for the operator to select variance from best rate (block 41). For this feature reference is again made to FIG. 2.

Figure 5:
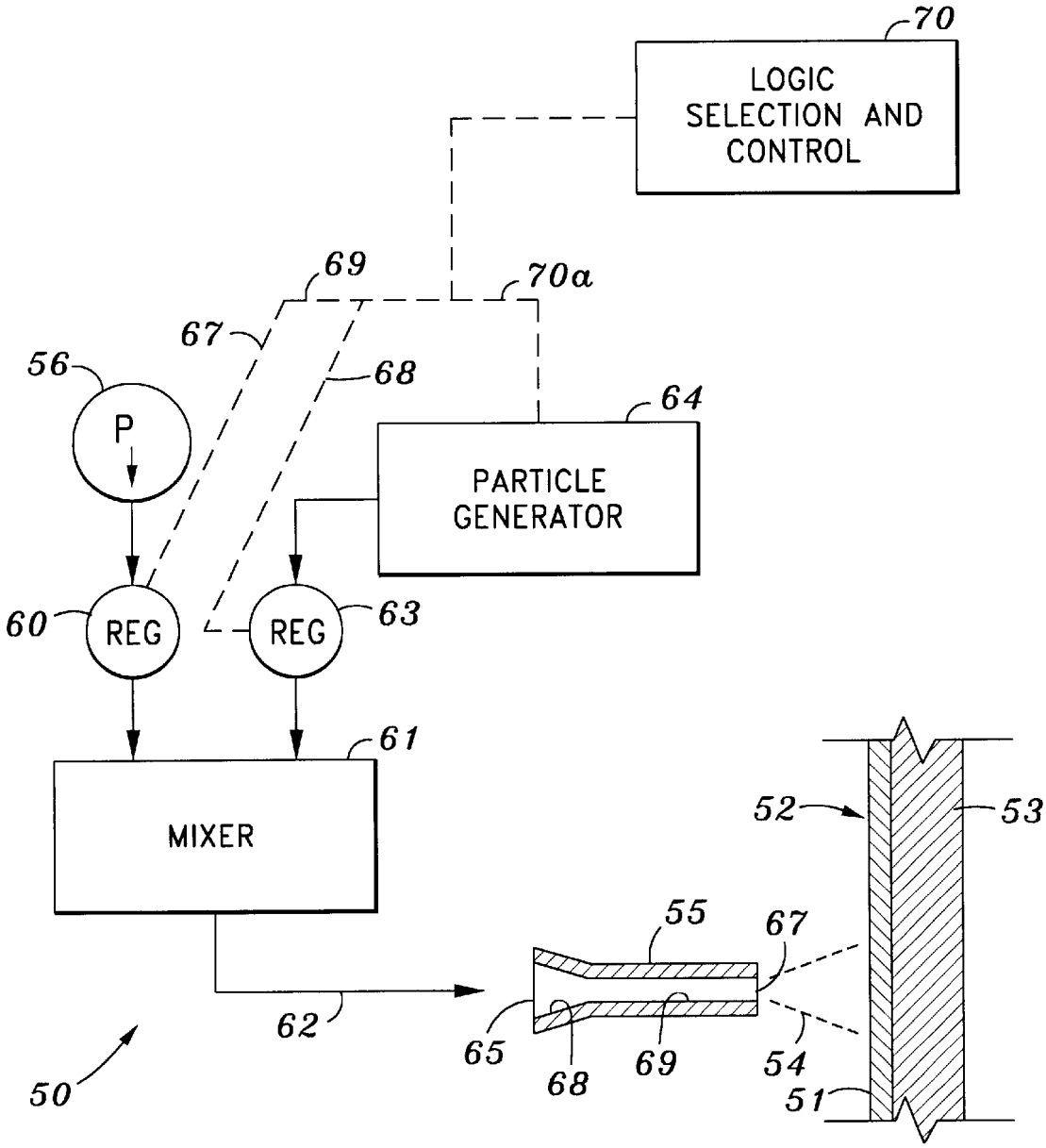
FIG. 5 is a semi-schematic view of an idealized system incorporating the invention.

An illustrative example of a system under the control of the logic of FIGS. 1–4 is shown in FIG. 5.

This system 50 is intended to clean an undesired substance 51 from surface 52 of a work piece 53 by emission 54 from a nozzle 55.

Carrier gas under pressure is derived from a pressure source 56 such as a compressor or a tank of stored liquified gas, as desired. Although air is the most frequently used gas, gassified liquid nitrogen, carbon dioxide or argon are other examples. Much depends on the convenience of the source. Most often this system will utilize a compressor and air rather than a cryogenic tank.

A flow regulator 60 ("first regulator") acting as a valve under feedback control from a flow meter establishes the rate of flow of the gas at the desired pressure. The regulated gas is supplied to a mixer 61, whose purpose is to combine the pressurized gas and dry ice particles and thereby provide a blasting stream to hose 62.

Dry ice particles are supplied to the mixer at a rate determined by a regulator 63 ("second regulator") that controls the output of a particle source 64. The mixed stream is presented to the entry port 65 of nozzle 55. Nozzle 55 has an orifice 67, with an initial converging section 68, and a diverging section 69. The divergence can be quite small, perhaps 1 ½ degrees half conical angle. The orifice is often circular but may be rectangular or any other suitable shape.

The regulators are respectively controlled to establish the relative rates of supply of gas and dry ice. They are adapted to deliver air and dry ice in relative mass ratios which will entrain and suitably deliver particles of the sizes intended to be used.

A suitable type of particle source shaves particles from a block of dry ice. A particle source able to make dry ice particles is available from CAE Alpheus, Inc. In addition to using this type of device directly to supply the dry ice, previously-prepared dry ice in a hopper can be dispensed. Accordingly, the term "particle source" means any controllable source of suitable dry ice particles.

In the operation of this system, the desired air flow rate at the selected pressure is set by regulator 60, acting as a flow meter-controlled regulator or other device which responds to conditions respective to flow rates, and as directed by the logic being used.

In turn, as shown by schematic lines 67, 68 and 69, regulator 63 is slaved to regulator 60 to cause the particle source to produce an appropriate amount of particles which, when added to the gas stream will produce a blasting stream with the desired gas/dry ice ratio. Line 70*a* indicates the control of the particle source by regulator 63.

The ultimate objective of this invention is to enable a correct gas/dry ice ratio along with a selected pressure and flow rate.

In FIG. 5, the logic, selection and control of any of the logic controls of FIGS. 1–4 is schematically shown in block 70 indicating reactive and dynamic apparatus and circuitry to control the regulators and the particle source. In fact, these three elements are the controlled ones. Once an agreed pressure and logic system have been selected, the consequence is ultimately to control the supply of ice to gas stream. Of course it will be recognized that a start-stop circuit may be interposed, but persons skilled in the control art will have no difficulty understanding such an arrangement.

The logical steps can be attended to by manual manipulation of controls in response to output from the logic, but when this invention is used as intended, the system is self-monitoring and automatically determine a best ratio and best ice supply rate, subject to override by the operator.

The determination of the flow rate for purpose of regulating the flow of gas can be made directly or indirectly. The classical directly responsive flow meter can readily be used.

However, indirect measurement of other parameters can enable one to deduce the flow rate. A potentially important arrangement involves knowledge of the flow through a given nozzle at a known pressure. It follows that, with a given nozzle, maintenance of pressure will provide a known and agreeable gas flow rate.

Accordingly, in this disclosure, the term "regulator" means a valve or other gas flow control device responsive to a signal which directly or indirectly measures or deduces the flow rate. The control relationships will be identical.

Because the permissible range may be extended toward a higher-number ratio when heavier pellets are used, and toward a lower-number ratio when lighter particles or shavings are used, the logic in all systems may be provided with responses to inputs relating to the nature of the dry ice heavier or lighter, and particle size.

When different nozzles are to be used, they can be substituted for one another and if desired color coded or otherwise identified. Then their properties can be placed in the reference, to add further limiting instructions for proposed uses of the invention.

This invention is not to be limited by the embodiments shown in the drawings and described in the description, which are given by way of example and not of limitation, but only in accordance with the scope of the appended claims.

We claim:

1. A system for producing a blasting stream consisting of dry ice particles, entrained in a stream of gas under pressure, said system comprising:

a first regulator receptive of a stream of carrier gas under pressure, adapted to maintain an output gas stream at a selected flow rate at a desired pressure;

a second regulator receptive of a sequence of dry ice particles, adapted to maintain said sequence at a regulated mass rate;

said second regulator being slaved to said first regulator to provide particles at such a rate as to fulfill the dry ice requirement for a selected gas/dry ice ratio;

a mixer combining the air and dry ice particles from said regulators to create a blasting stream with the selected ratio;

a hose receiving the blasting stream from said mixer;

a nozzle attached to said hose, said nozzle having an orifice with an open cross-section from which the blasting stream is discharged;

logic and control circuitry responsive to command for an operating pressure and resulting gas flow rate establishing a preferred range of values for the ratio of gas/dry ice, and actuating instructions to provide dry ice at a rate to mix with the stream of air and constitute a blasting stream with a gas/dry ice ratio within said preferred range.

2. Apparatus according to claim 1 in which said first regulator is responsive to measured or deduced flow rates of gas at said intended gas pressure, said second regulator being slaved to said first regulator so that, when a said ratio is permitted, it will produce a stream of particles which in the gas stream will provide the intended ratio.

3. Apparatus according to claim 1 in which said circuitry includes a selector for a desired ratio, a reference to determine whether or not said ratio is permissible.

4. Apparatus according to claim 3 in which said selected ratio is adjustable, but only within the permitted range.

5. Apparatus according to claim 4 in which first regulator responds to a flow meter.

6. Apparatus according to claim 1 in which said first regulator responds to pressure and to information regarding flow properties of the nozzle, from which gas flow rate can be deduced.

7. Apparatus according to claim 6 in which a plurality of nozzles with different flow characteristics are selectively provided, whereby said logic circuitry is responsive not only to actual gas flow rate, but also to gas flow rate deduced from pressure and from nozzle properties.

8. A method to enable a blasting stream to be selected and produced consisting of a carrier gas under pressure and dry ice particles in a permitted gas/dry ice ratio, said method utilizing a first regulator to regulate the mass flow of gas, and a second regulator to regulate the mass flow of dry ice particles, the gas and dry ice particles to be mixed to constitute the blasting stream, the second regulator being slaved to the first regulator so as to provide dry ice particles in the appropriate amount for the selected ratio, the method comprising:

selecting a desired operating gas pressure;

considering a desired gas flow rate at said pressure with the intention of adding dry ice particles at a given ratio of gas/dry ice;

referring to information providing a range of permissible ratios at a given or selected pressure;

selecting a ratio;

if the selected ratio is inside the permissible range, authorizing the start of the system, and maintaining the selected ratio.

9. The method of claim 8 in which after authorization, the ratio can be changed, but only within the permissible range.

10. The method of claim 8 in which the circuitry dynamically responds to the two regulators in order to maintain the selected ratio.

11. The method of claim 10 in which the first regulator is a flow meter.

12. The method of claim 10 in which the first regulator is a pressure gauge, which when combined with information regarding the flow characteristics of the nozzle, can deduce the gas flow rate.

13. The method of claim 8 in which selection of a heavier particle extends the permissible ratio toward a higher-number ratio, and selective of a lighter particle extends the permissible ratio toward a lower-number ratio.

14. Apparatus according to claim 1 in which the logic and control circuitry further responds to information regarding the selection of the mass of the dry ice particles.

15. Apparatus according to claim 14 in which selection of a heavier particle extends the permissible ratio toward a higher-number ratio, and selective of a lighter particle extends the permissible ratio toward a lower-number ratio.

* * * * *